US008169383B2

(12) United States Patent
Weitbruch et al.

(10) Patent No.: US 8,169,383 B2
(45) Date of Patent: May 1, 2012

(54) DISPLAY METHOD IN AN ACTIVE MATRIX DISPLAY DEVICE

(75) Inventors: Sébastien Weitbruch, Kappel (DE); Ingo Doser, Villingen-Schwenningen (DE); Sylvain Thiebaud, Noyal sur Vilaine (FR)

(73) Assignee: Thomson Licensing, Boulogne-Billancourt (FR)

( * ) Notice: Subject to any disclaimer, the term of this patent is extended or adjusted under 35 U.S.C. 154(b) by 716 days.

(21) Appl. No.: 12/085,039

(22) PCT Filed: Nov. 13, 2006

(86) PCT No.: PCT/EP2006/068409

§ 371 (c)(1),
(2), (4) Date: May 14, 2008

(87) PCT Pub. No.: WO2007/057376

PCT Pub. Date: May 24, 2007

(65) Prior Publication Data

US 2009/0051710 A1 Feb. 26, 2009

(30) Foreign Application Priority Data

Nov. 16, 2005 (EP) ..... 05292435

(51) Int. Cl.
*G09G 3/36* (2006.01)

(52) U.S. Cl. ..... 345/76

(58) Field of Classification Search ..... 345/76
See application file for complete search history.

(56) References Cited

U.S. PATENT DOCUMENTS

| | | | | |
|---|---|---|---|---|
| 6,188,375 | B1 | 2/2001 | Kagey | |
| 6,392,656 | B1 | 5/2002 | Someya et al. | |
| 2003/0025656 | A1 * | 2/2003 | Kimura | 345/82 |
| 2004/0012340 | A1 * | 1/2004 | Yasuda et al. | 315/169.3 |
| 2005/0140604 | A1 * | 6/2005 | Shin | 345/76 |
| 2005/0243282 | A1 * | 11/2005 | Peterson et al. | 353/31 |

FOREIGN PATENT DOCUMENTS

| | | |
|---|---|---|
| EP | 1531452 | 5/2005 |
| WO | WO 03/081569 | 10/2003 |
| WO | WO 03081569 | 10/2003 |

OTHER PUBLICATIONS

Search Report Dated Feb. 15, 2007.

* cited by examiner

*Primary Examiner* — Amr Awad
*Assistant Examiner* — Jonathan Boyd
(74) *Attorney, Agent, or Firm* — Tutunjian & Bitetto, P.C.

(57) ABSTRACT

The present invention relates to a method for displaying an image in an active matrix display device and more particularly in an active matrix OLED (Organic Light Emitting Display) display. The purpose of this invention is to increase the video dynamic range of each color component. The voltages applied to the OLED cells are based on reference voltages or currents. According to the invention, a different set of reference voltages is used for each color component. To this end, the video frame is divided into at least three sub-frames and at least one color component of the picture is addressed during each subframe with a set of reference voltages adapted to said color component.

4 Claims, 12 Drawing Sheets

DISPLAY METHOD IN AN ACTIVE MATRIX DISPLAY DEVICE

This application claims the benefit, under 35 U.S.C. §365 of International Application PCT/EP2006/068409, filed Nov. 13, 2006, which was published in accordance with PCT Article 21(2) on May 24, 2007 in English and which claims the benefit of European patent application No. 05292435.4 filed Nov. 16, 2005.

The present invention relates to a method for displaying an image in an active matrix display device and more particularly in an active matrix OLED (Organic Light Emitting Display) display. This method has been more particularly but not exclusively developed for video application.

BACKGROUND OF THE INVENTION

The structure of an active matrix OLED or AM-OLED is well known. It comprises:

- an active matrix containing, for each cell, an association of several thin film transistors (TFT) with a capacitor connected to an OLED material; the capacitor acts as a memory component that stores a value during a part of the video frame, this value being representative of a video information to be displayed by the cell during the next video frame or the next part of the video frame; the TFTs act as switches enabling the selection of the cell, the storage of a data in the capacitor and the displaying by the cell of a video information corresponding to the stored data;
- a row or gate driver that selects line by line the cells of the matrix in order to refresh their content;
- a column or source driver that delivers the data to be stored in each cell of the current selected line; this component receives the video information for each cell; and
- a digital processing unit that applies required video and signal processing steps and that delivers the required control signals to the row and column drivers.

Actually, there are two ways for driving the OLED cells. In a first way, each digital video information sent by the digital processing unit is converted by the column drivers into a current whose amplitude is proportional to the video information. This current is provided to the appropriate cell of the matrix. In a second way, the digital video information sent by the digital processing unit is converted by the column drivers into a voltage whose amplitude is proportional to the video information. This current or voltage is provided to the appropriate cell of the matrix.

From the above, it can be deduced that the row driver has a quite simple function since it only has to apply a selection line by line. It is more or less a shift register. The column driver represents the real active part and can be considered as a high level digital to analog converter. The displaying of a video information with such a structure of AM-OLED is the following. The input signal is forwarded to the digital processing unit that delivers, after internal processing, a timing signal for row selection to the row driver synchronized with the data sent to the column drivers. The data transmitted to the column driver are either parallel or serial. Additionally, the column driver disposes of a reference signaling delivered by a separate reference signaling device. This component delivers a set of reference voltages in case of voltage driven circuitry or a set of reference currents in case of current driven circuitry. The highest reference is used for the white and the lowest for the black level. Then, the column driver applies to the matrix cells the voltage or current amplitude corresponding to the data to be displayed by the cells.

In order to illustrate this concept, an example of a voltage driven circuitry is described below. Such a circuitry will also used in the rest of the present specification for illustrating the invention. The driver taken as example uses 8 reference voltages named $V_0$ to $V_7$ and the video levels are built as shown below:

| Video level | Grayscale voltage level | Output Voltage |
|---|---|---|
| 0 | V7 | 0.00 V |
| 1 | V7 + (V6 − V7) × 9/1175 | 0.001 V |
| 2 | V7 + (V6 − V7) × 32/1175 | 0.005 V |
| 3 | V7 + (V6 − V7) × 76/1175 | 0.011 V |
| 4 | V7 + (V6 − V7) × 141/1175 | 0.02 V |
| 5 | V7 + (V6 − V7) × 224/1175 | 0.032 V |
| 6 | V7 + (V6 − V7) × 321/1175 | 0.045 V |
| 7 | V7 + (V6 − V7) × 425/1175 | 0.06 V |
| 8 | V7 + (V6 − V7) × 529/1175 | 0.074 V |
| 9 | V7 + (V6 − V7) × 630/1175 | 0.089 V |
| 10 | V7 + (V6 − V7) × 727/1175 | 0.102 V |
| 11 | V7 + (V6 − V7) × 820/1175 | 0.115 V |
| 12 | V7 + (V6 − V7) × 910/1175 | 0.128 V |
| 13 | V7 + (V6 − V7) × 998/1175 | 0.14 V |
| 14 | V7 + (V6 − V7) × 1086/1175 | 0.153 V |
| 15 | V6 | 0.165 V |
| 16 | V6 + (V5 − V6) × 89/1097 | 0.176 V |
| 17 | V6 + (V5 − V6) × 173/1097 | 0.187 V |
| 18 | V6 + (V5 − V6) × 250/1097 | 0.196 V |
| 19 | V6 + (V5 − V6) × 320/1097 | 0.205 V |
| 20 | V6 + (V5 − V6) × 386/1097 | 0.213 V |
| 21 | V6 + (V5 − V6) × 451/1097 | 0.221 V |
| 22 | V6 + (V5 − V6) × 517/1097 | 0.229 V |
| . . . | . . . | . . . |
| 250 | V1 + (V0 − V1) × 2278/3029 | 2.901 V |
| 251 | V1 + (V0 − V1) × 2411/3029 | 2.919 V |
| 252 | V1 + (V0 − V1) × 2549/3029 | 2.937 V |
| 253 | V1 + (V0 − V1) × 2694/3029 | 2.956 V |
| 254 | V1 + (V0 − V1) × 2851/3029 | 2.977 V |
| 255 | V0 | 3.00 V |

A more complete table is given in Annex 1. This table illustrates the output voltage for various input video levels. The reference voltages used are for example the following ones:

| Reference $V_n$ | Voltage (Volts) |
|---|---|
| V0 | 3 |
| V1 | 2.6 |
| V2 | 2.2 |
| V3 | 1.4 |
| V4 | 0.6 |
| V5 | 0.3 |
| V6 | 0.16 |
| V7 | 0 |

Actually, there are three ways for making colored displays

- a first possibility illustrated by FIG. 1 is to use a white OLED emitter having on top photopatternable color filters; this type of display is similar to the current LCD displays where the color is also done by using color filters; it has the advantage of using one single OLED material deposition and of having a good color tuning possibility but the efficiency of the whole display is limited by the color filters.
- a second possibility illustrated by FIG. 2 is to use blue OLED emitters having on top photopatternable color converters for red and green; such converters are mainly based on materials that absorb a certain spectrum of light and convert it to an other spectrum that is always lower; this type of display has the advantage of using one single OLED material deposition but the efficiency of the whole display is limited by the color converters; furthermore, blue materials are needed since the spectrum of the light can only be reduced by the converters but the blue materials are always the less efficient both in terms of light emission and lifetime.

a third possibility illustrated by FIG. 3 is to use different OLED emitters for the 3 colours red, green and blue. This type of display requires at least 3 material deposition steps but the emitters are more efficient since not filtered.

The invention is more particularly adapted to the displays of FIG. 3. It can be also used for the other types of display but with fewer advantages.

The use of three different OLED materials (one par color) implies that they all have different behaviors. This means that they all have different threshold voltages and different efficiencies as illustrated by FIG. 4. In the example of FIG. 4, the threshold voltage $VB_{th}$ of the blue material is greater than the threshold voltage $VG_{th}$ of the green material that is itself greater than the threshold voltage $VR_{th}$ of the red material. Moreover, the efficiency of the green material is greater than the efficiencies of the red and blue materials. Consequently, in order to achieve a given color temperature, the gain between these 3 colors must be further adjusted depending on the material color coordinates in the space. For instance, the following materials are used:

Red (x=0.64; y=0.33) with 6 cd/A and VRth=3V

Green (x=0.3; 0.6) with 20 cd/A and VGth=3.3V

Blue (x=0.15; 0.11) with 4 cd/A and VRth=3.5V

Thus a white color temperature of 6400° K (x=0.313; y=0.328) is achieved by using 100% of the red, 84% of the green and 95% of the blue.

If one driver with only one set of reference signals (voltages or currents) for the 3 colors is used and if the maximum voltage to be applied to the cells is 7 Volts (=Vmax), the voltage range must be from 3V to 7V but only a part of the available dynamic can be used and all corrections must be done digitally. Such a correction will reduce the video dynamic of the whole display. FIG. 5 illustrates the final used video dynamic for the 3 colours. More particularly, the FIG. 5 shows the range used for each diode (colour material) in order to have proper color temperature and black level. Indeed, the minimum voltage Vmin (=V7 in the previous table) to be applied to the diodes must be chosen equal to 3V to enable switching OFF the red diode and the lowest lighting voltage (=V7+(V6−V7)×9/175 in the previous table) must be chosen according the blue threshold level to adjust black level. The maximum voltage to be chosen for each diode is adapted to the white color temperature that means 100% red, 84% green and 95% blue. Finally, it can be seen that only a very small part of the green video range is used.

Since the video levels between 3V and 7V are defined with 256 bits, it means that the green component is displayed with only a few digital levels. The red component uses a bit more gray level but this is still not enough to provide a satisfying picture quality. A solution would be to use specific drivers having for all three color outputs a different reference signaling but such drivers are either not available or quite expensive.

INVENTION

It is an object of the present invention to propose a method to remedy to these drawbacks.

According to the invention, this object is solved by a method for displaying a picture in an active matrix organic light emitting display having a plurality of luminous elements each dedicated to a colour component among at least three colour components of pixels of a picture, wherein the luminance generated by each of said luminous elements is based on the intensity of a signal supplied to said luminous element, the intensity of said signal being defined as a function of reference signals. It comprises the following steps:

addressing the picture at least three times during the video frame such that the video frame is split into at least three sub-frames, at least one colour component being associated to each subframe, and displaying, during each sub-frame, the associated colour component with a set of reference signals dedicated to said colour component.

The three colour components are for example a red component, a green component and a blue component.

In a first embodiment, the red component is displayed during the first sub-frame with the set of reference signals dedicated to said colour component, the green component is displayed during the second sub-frame with the set of reference signals dedicated to said colour component and the blue component is displayed during the third sub-frame with the set of reference signals dedicated to said colour component.

In a preferred embodiment, the red, green and blue components are displayed during the first sub-frame with the set of reference signals dedicated to the green component, the red and blue components are displayed during the second sub-frame with the set of reference signals dedicated to the red component and the blue component is displayed during the third sub-frame with the set of reference signals dedicated to said colour component.

Advantageously, the durations of the sub-frame are different and are chosen for reducing the voltages applied to the luminous elements in order to increase the lifetime of the luminous elements. For example, the duration of the first sub-frame is lower than the duration of the second sub-frame and the duration of the second sub-frame is lower than the duration of the third sub-frame.

Advantageously, the three sub-frames are interleaved such that two consecutive rows of pixels are addressed sequentially for displaying different colour components.

The invention concerns also a display device comprising an active matrix containing an array of luminous elements arranged in rows and columns, each luminous element being used for displaying a colour component among at least three colour components of pixels of a picture to be displayed a row driver for selecting row by row the luminous elements of the matrix;

a column driver for delivering a signal to each luminous element of the row selected by the row driver, said signal depending on the video information to be displayed by said luminous element and a set of reference signals; and a digital processing unit for delivering the video information and the set of reference signals to the column driver and control signals to the row driver.

The digital processing unit is designed to control the row driver and to deliver video information and reference signals to the column driver such that the picture is addressing at least three times during the video frame and that the video frame is split into at least three sub-frames, at least one colour component being associated to each subframe, and during each sub-frame, the associated colour component is displayed with a set of reference signals dedicated to said colour component.

BRIEF DESCRIPTION OF THE DRAWINGS

Exemplary embodiments of the invention are illustrated in the drawings and are explained in more detail in the following description. In the drawings.

DESCRIPTION OF PREFERRED EMBODIMENTS

Figure 1:
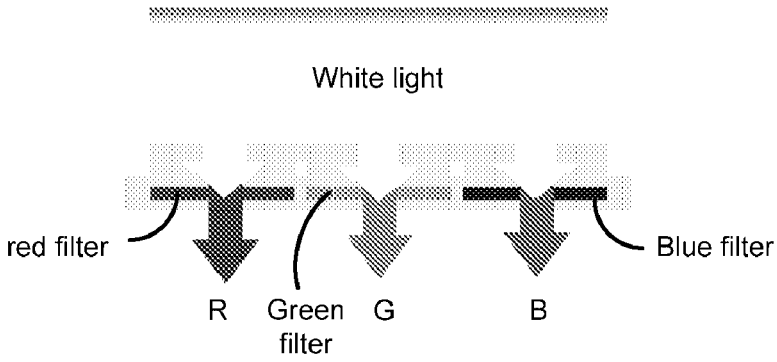
FIG. 1 shows a white OLED emitter having 3 color filters for generating the red, green and blue colours.
Figure 2:
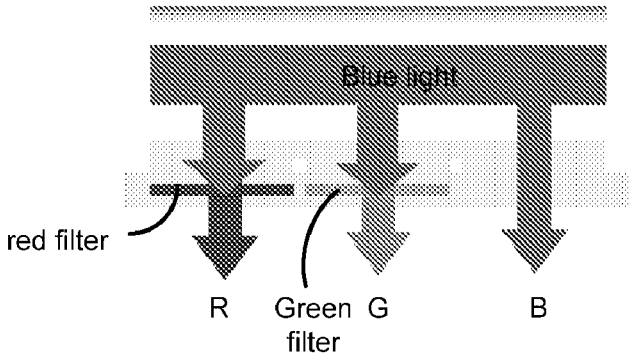
FIG. 2 shows a blue OLED emitter having 2 color filters for generating the red, green and blue colours.
Figure 3:
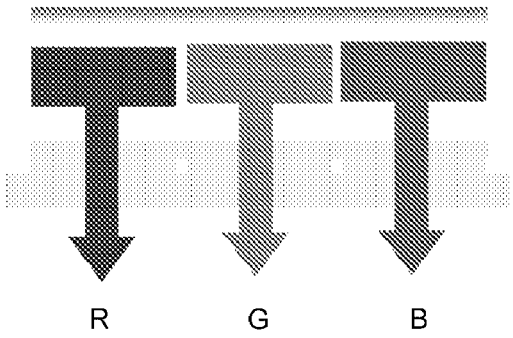
FIG. 3 shows a red OLED emitter, a green OLED emitter and a blue OLED emitter for generating the red, green and blue colours.
Figure 4:
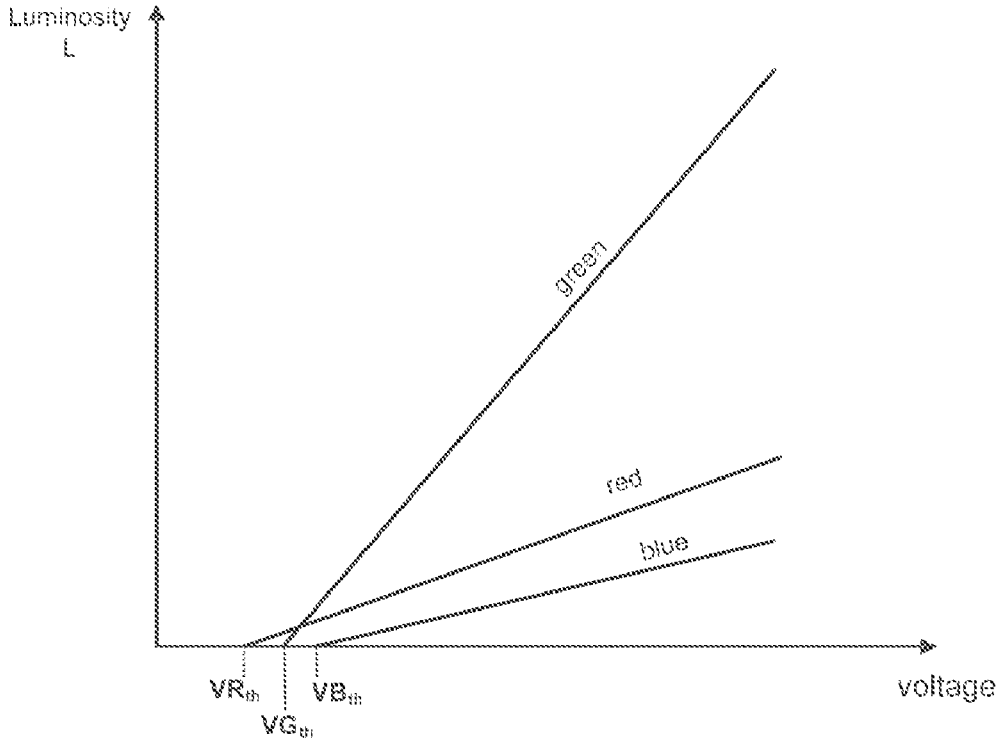
FIG. 4 is a schematic diagram illustrating the threshold voltages and the efficiencies of blue, green and red OLED materials.
Figure 5:
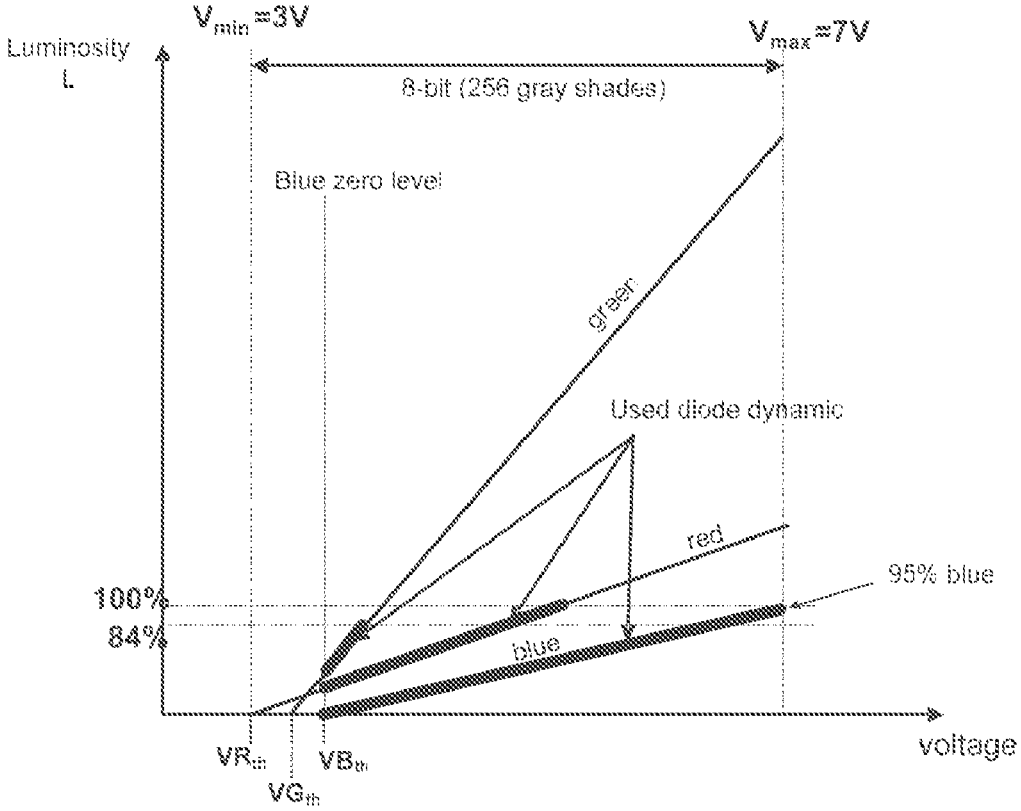
FIG. 5 shows the video range used for each blue, green and red OLED material of FIG. 4.
Figure 6:
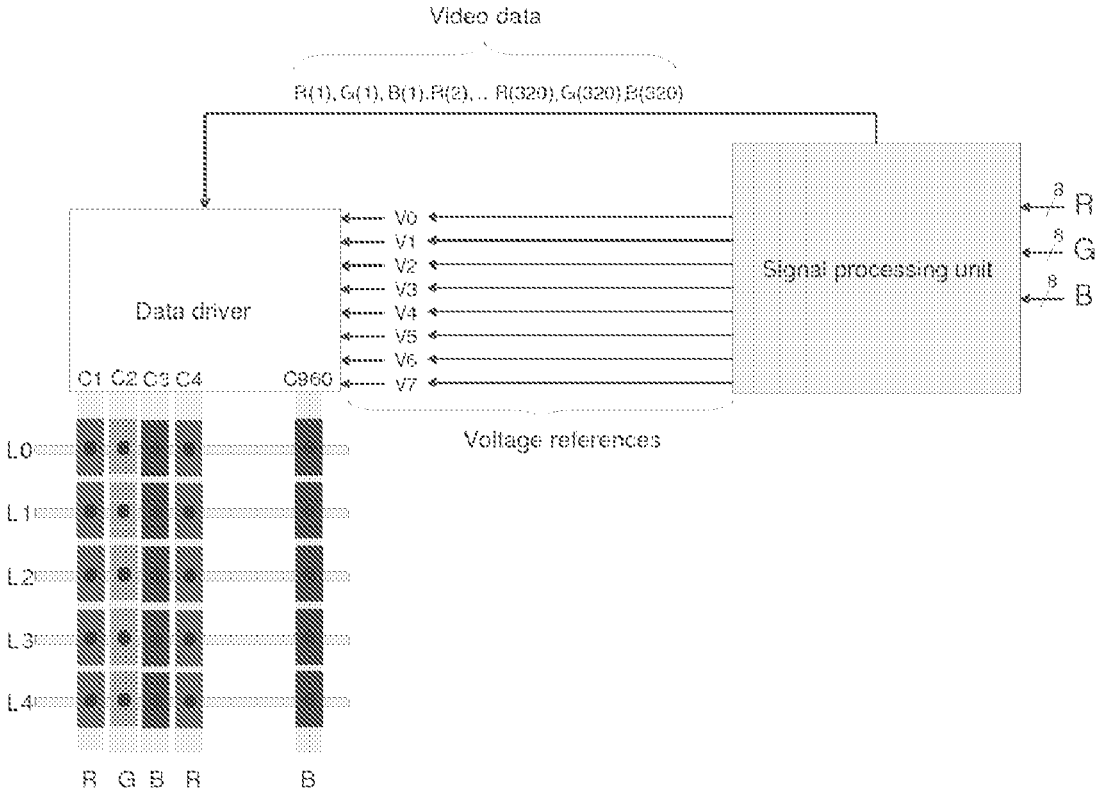
FIG.6 (prior art)
FIG. 6 illustrates the standard addressing of video data in an AMOLED display.

FIG. 6 illustrates the standard addressing of video data are addressing in an AMOLED display. The matrix of luminous elements comprises for example 320×3=960 columns (320 columns per colour) C1 to C960 and 240 rows L0 to L239 like a QVGA display (320×240 pixels). For the sake of simplicity, only 5 rows L0 to L4 are shown in this figure. C1 is a column of red luminous elements, C2 is a column of green luminous elements, C3 is a column of blue luminous elements, C4 is a column of red luminous elements and so on. The video data of the picture to be displayed are processed by a signal processing unit that delivers the video data R(1), G(1), B(1), R(2), G(2), B(2), . . . R(320), G(320), B(320) for a line of luminous elements and the reference voltages to be used for displaying said video data to a data driver having 960 outputs, each output being connected to a column of the matrix. The same set of reference voltages is used for all the video data. Consequently, to display colors, this standard addressing requires an adjustment of the reference voltages combined with a video adjustment of the three colors. These adjustments does not prevent from having a large loss of the video dynamic as shown in FIG. 5.

The invention presented here is a specific addressing that can be used in a standard active matrix OLED. The idea is to have a set of reference voltages (or currents) for each colour and to address three times per frame the luminous elements of the display such that the video frame is divided into three sub-frames, each sub-frame being adapted to display mainly a dedicated color by using the corresponding set of reference voltages. The main color to be displayed changes at each sub-frame as the set of reference voltages.

For example, the red colour is displayed during the first sub-frame with the set of reference voltages dedicated to the red colour, the green colour is displayed during the second sub-frame with the set of reference voltages dedicated to the green colour and the blue colour is displayed during the third sub-frame with the set of reference voltages dedicated to the blue colour.

Figure 7:
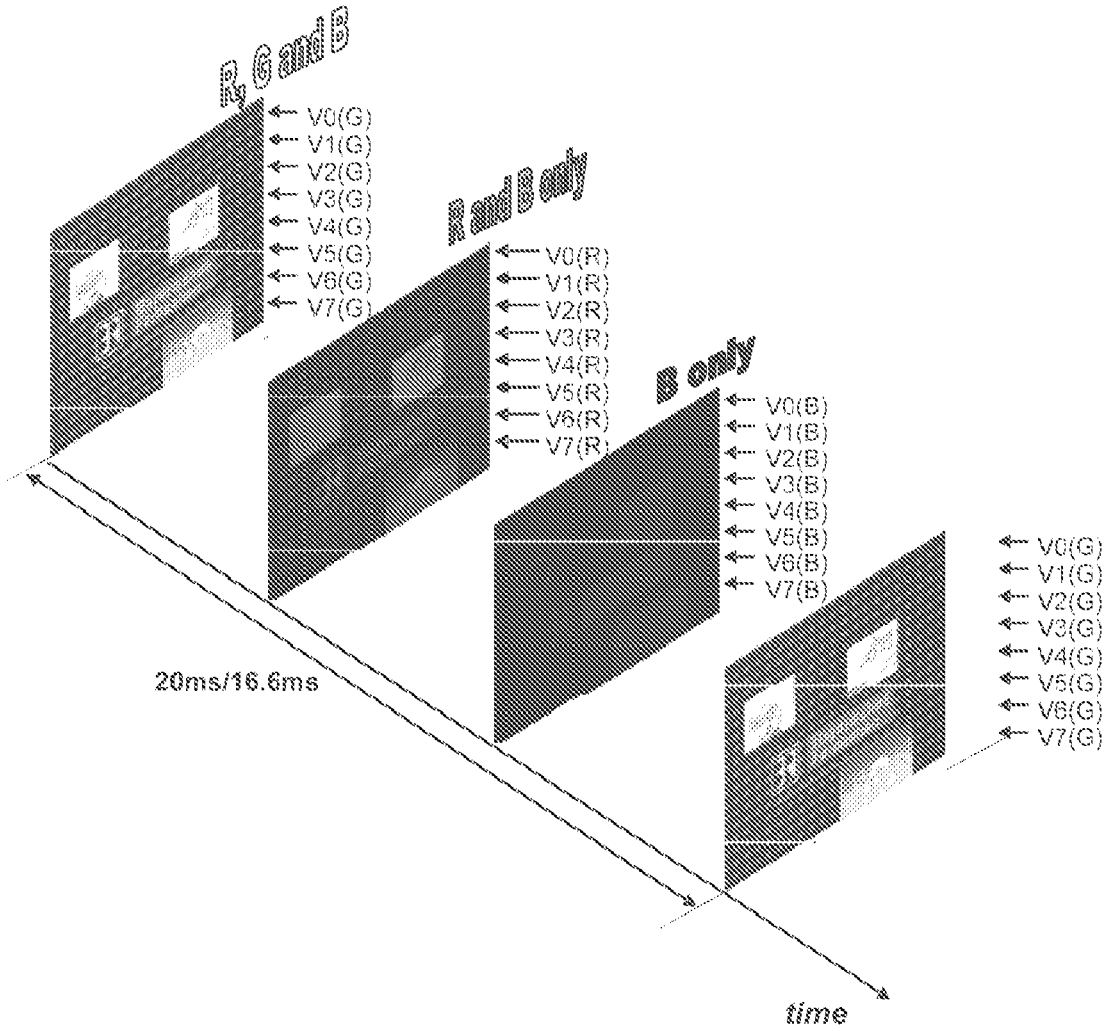
FIG. 7 illustrates the addressing of video data in an AMOLED display according to the invention.

The invention will be explained in more detail in reference to FIG. 7 that illustrates a preferred embodiment. During the first sub-frame, the three components are displayed using the reference voltages adapted to the green component to dispose of a full grayscale dynamic for this component. {V0(G), V1(G), V2(G), V3(G), V4(G), V5(G), V6(G), V7(G)} designates the set of reference voltages dedicated to the green component. The two other components are only partially displayed. So the sub-picture displayed during this sub-frame is greenish/yellowish. During the second sub-frame, the green component is deactivated (set to zero) and the voltages are adapted to dispose of a full dynamic for the red component by using the set of reference voltages dedicated to the red component {V0(R), V1(R), V2(R), V3(R), V4(R), V5(R), V6(R), V7(R)}. The sub-picture displayed during this sub-frame is purplish. Finally during the third sub-frame, the green and red components are deactivated (set to zero) and the voltages are adapted to dispose of a full dynamic for the blue component by using the set of reference voltages dedicated to the blue component {V0(B), V1(B), V2(B), V3(B), V4(B), V5(B), V6(B), V7(B)}.

According to the invention, it is now possible to adjust the 8 reference voltages (or currents) at each sub-frame. The only particularity is that the lowest reference voltages must be kept equal to the lowest threshold voltage of the three colors. Indeed, displaying a blue component means having red and green components equal to zero, which means equal to V7 in our example that is the lowest reference voltage. So, this voltage must be low enough to have them really black. In the example of FIG. 5, we must have $$V7(R)=V7(B)=V7(G)=VR_{th}.$$

The only additional requirement is the necessity of addressing the matrix three times faster.

Figure 8:
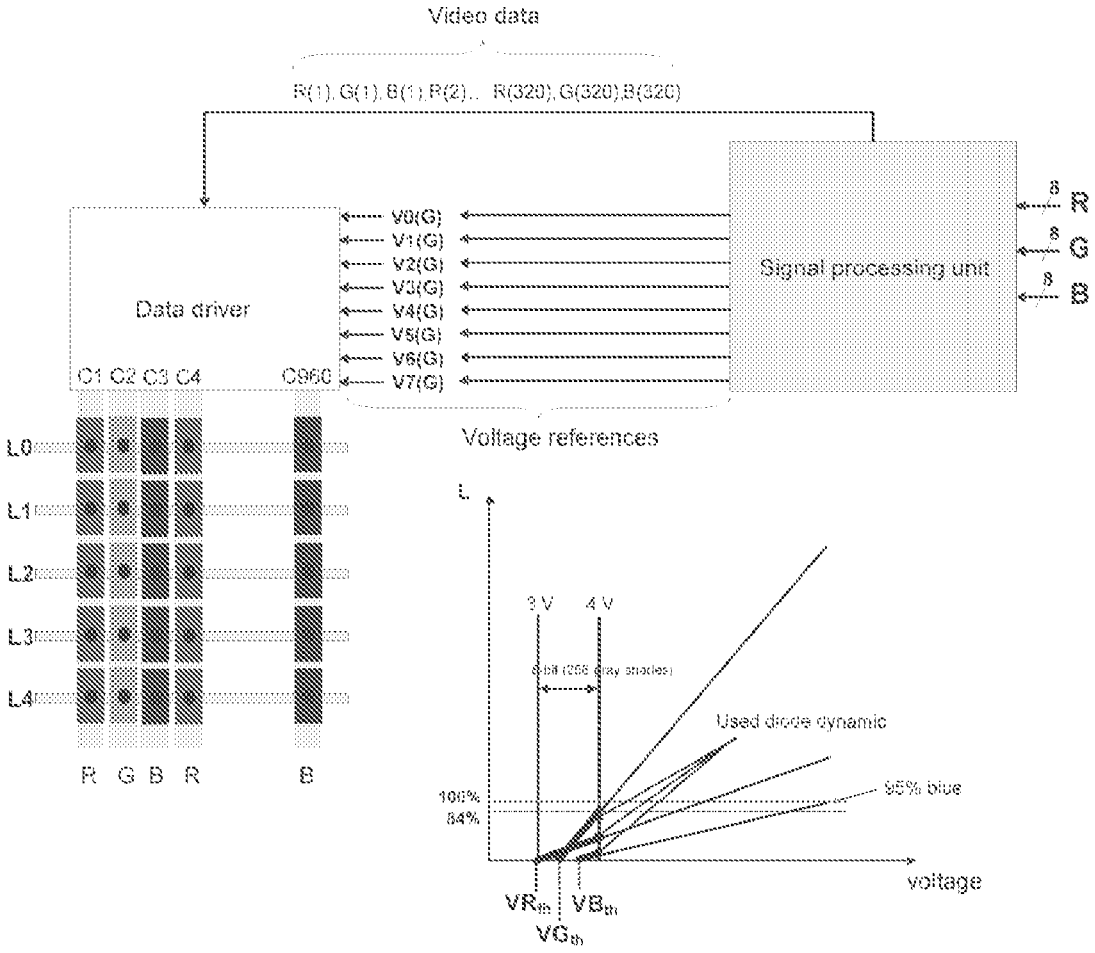
FIG. 8 illustrates the addressing of video data in an AMOLED display during a first sub-frame of the video frame.
Figure 9:
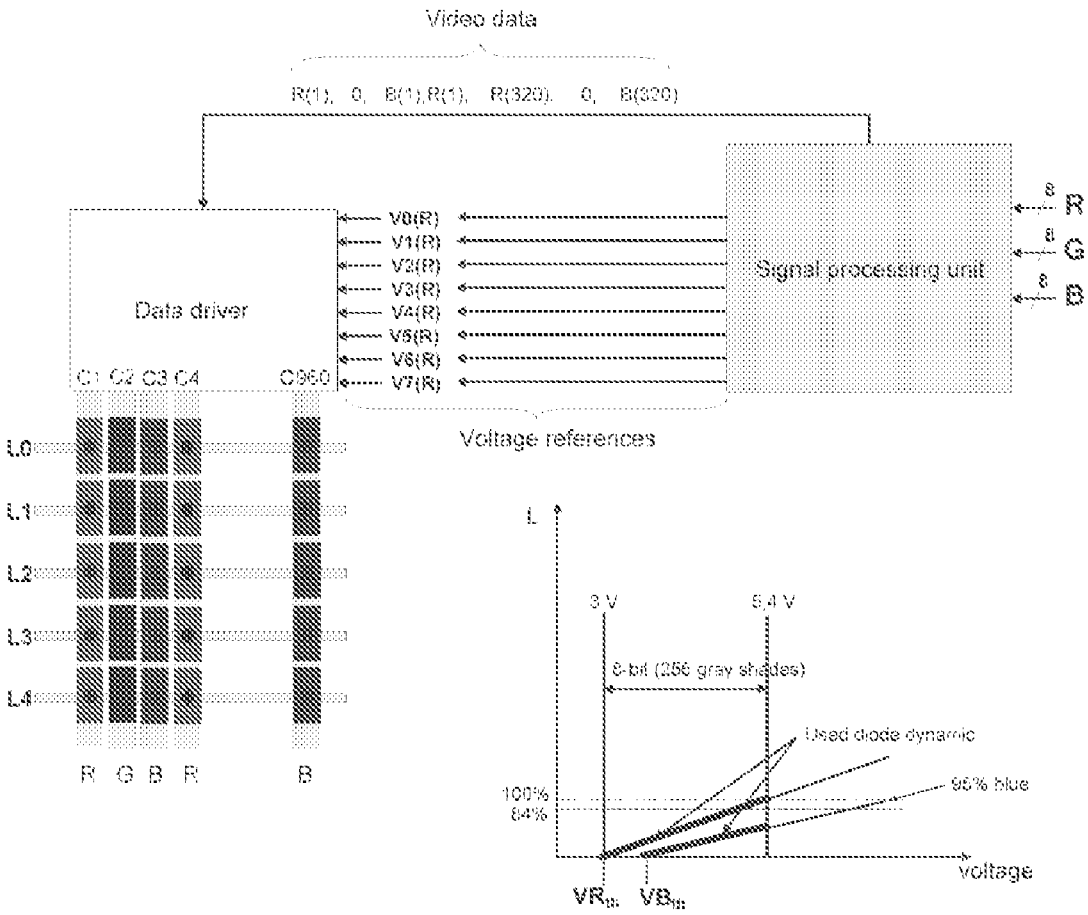
FIG. 9 illustrates the addressing of video data in an AMOLED display during a second sub-frame of the video frame.
Figure 10:
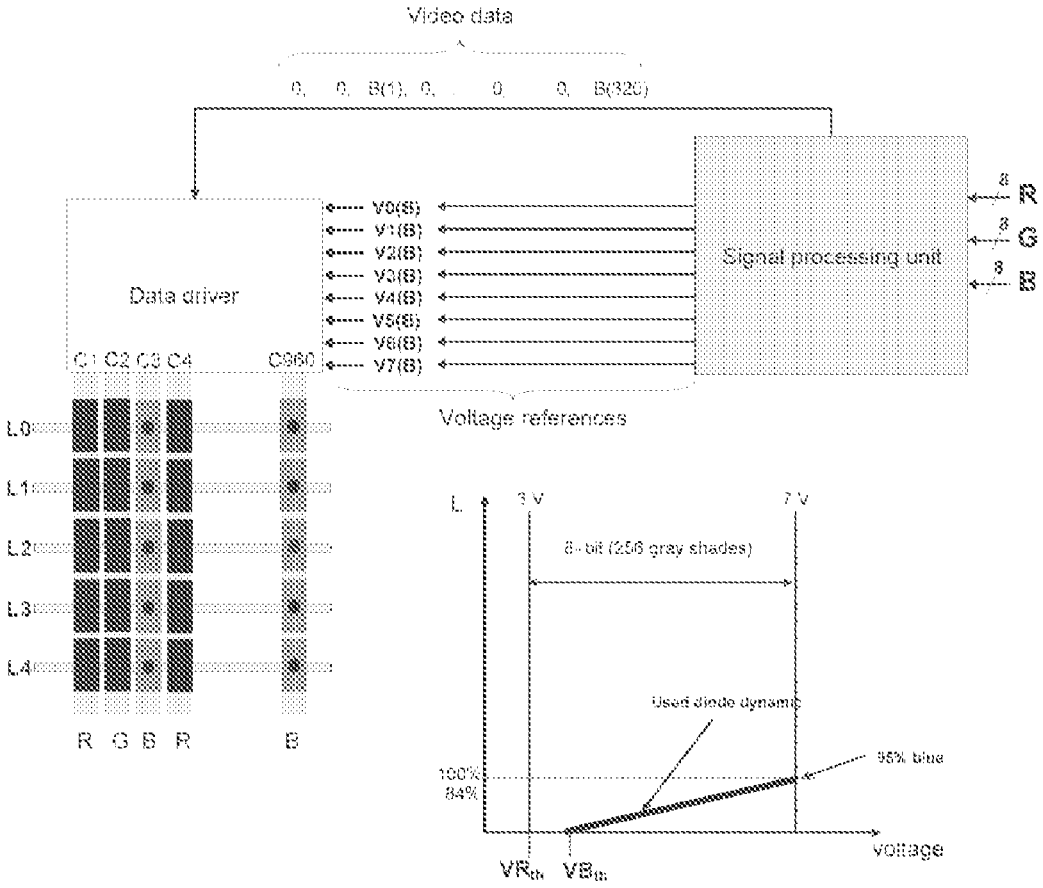
FIG. 10 illustrates the addressing of video data in an AMOLED display during a third sub-frame of the video frame.

FIGS. 8 to 10 illustrates the functioning of the display device during the three sub-frames. In reference to FIG. 8, during the first sub-frame, the video data of the picture to be displayed are converted into voltages to be applied to the luminous elements of the matrix by the data driver that uses the set of reference voltages dedicated to the green component. The set of reference voltages are distributed between 3 volts (=V7(G)=$VR_{th}$) and about 4 volts=V0(G) that is the maximum voltage that can be used for displaying the green component.

An example of reference voltages for the green component is given below

| Reference $V_n$ | Voltage (Volts) |
|---|---|
| V0 | 4 |
| V1 | 3.85 |
| V2 | 3.75 |
| V3 | 3.45 |
| V4 | 3.2 |
| V5 | 3.1 |

-continued

| Reference $V_n$ | Voltage (Volts) |
|---|---|
| V6 | 3.05 |
| V7 | 3 |

In reference to FIG. 9, during the second sub-frame, the video data of the picture to be displayed are converted into voltages to be applied to the luminous elements of the matrix by the data driver that uses the set of reference voltages dedicated to the red component. The video data corresponding to the green component are set to zero. The set of reference voltages are distributed between 3 volts (=V7(R)=$VR_{th}$) and about 5.4 volts=V0(R) that is the maximum voltage that can be used for displaying the red component.

An example of reference voltages for the red component is given below

| Reference $V_n$ | Voltage (Volts) |
|---|---|
| V0 | 5.4 |
| V1 | 5.08 |
| V2 | 4.76 |
| V3 | 4.12 |
| V4 | 3.48 |
| V5 | 3.24 |
| V6 | 3.13 |
| V7 | 3 |

In reference to FIG. 10, during the third sub-frame, the video data of the picture to be displayed are converted into voltages to be applied to the luminous elements of the matrix by the data driver that uses the set of reference voltages dedicated to the blue component. The video data corresponding to the green component are set to zero. The set of reference voltages are distributed between 3 volts (=V7(G)=$VR_{th}$) and about 7 volts=V0(B) that is the maximum voltage that can be used for displaying the blue component.

An example of reference voltages for the blue component is given below

| Reference $V_n$ | Voltage (Volts) |
|---|---|
| V0 | 7 |
| V1 | 6.46 |
| V2 | 5.93 |
| V3 | 4.86 |
| V4 | 3.8 |
| V5 | 3.4 |
| V6 | 3.21 |
| V7 | 3 |

In a more general manner, the colour component having the highest luminosity capabilities (in our example, the green component) is displayed only in the first sub-frame. The colour component having the lowest luminosity capabilities (in our example, the blue component) is displayed in the three sub-frames. And the colour component having in-between luminosity capabilities (in our example, the red component) is displayed during two sub-frames.

Figure 11:
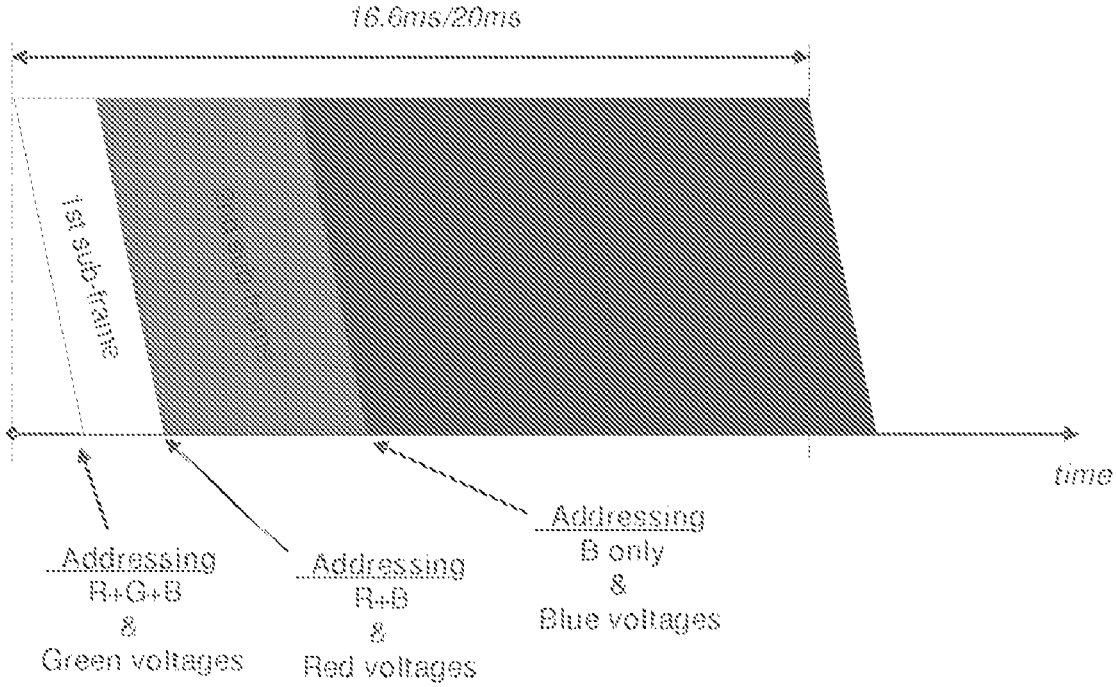
FIG. 11 illustrates an embodiment where the sub-frames have different durations.

Advantageously, the duration of the three sub-frames are different and are adapted in order to avoid increasing too much the voltages of a dedicated color component. The color temperature of the display can be adjusted by varying the active time duration of each color component (duration of the sub-frame). This improvement is illustrated by FIG. 11 where the duration of the third sub-frame dedicated to the blue component is particularly extended. In this figure, the duration chosen for each sub-frame is proportional to the diode working segment (or used diode dynamic) of the corresponding color component shown in FIG. 5. It enhances the lifetime of the luminous elements of each color avoiding increasing the voltage to be applied to them. Moreover, it is possible to further increase the duration of a dedicated color suffering from low lifetime to avoid any differential ageing.

Figure 12:
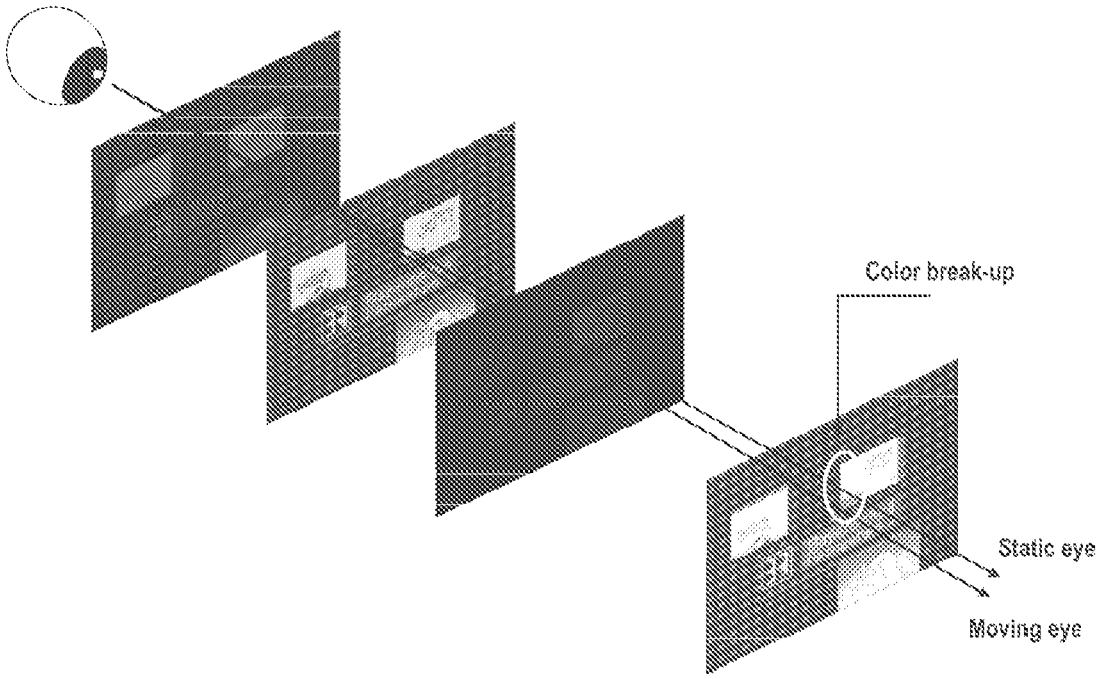
FIG. 12 illustrates the color break-up artifact.

This invention can also be improved because the display device implementing it can suffer from an artifact called "color break-up". It is working like a display device based on color-multiplexing by a color-wheel like a DLP (Digital Light Processing) display device for instance. This artifact can be observed when the eye is moving rapidly or while following a rapid movement. It is illustrated by FIG. 12. As the eye is moving and follows the motion, the three colors are displayed one after the other.

According to the invention, it is proposed to do a color interleaving line by line. Indeed, in FIG. 7, all the lines of the matrix are scanned one after the other during each sub-frame for the same color management: during the first sub-frame, all lines are addressed for displaying red, green and blue components, then during the second sub-frame, they are addressed for displaying red and blue components and then, during the third sub-frame, they are addressed for displaying the blue component. According to the invention, the addressing is modified and the three sub-frames are interleaved. A first line is addressed for displaying the three color components, then a second line is addressed for displaying the blue and red components, then a third line is addressed for displaying the blue component and so on, as illustrated by FIGS. 13 to 15.

Figure 13:
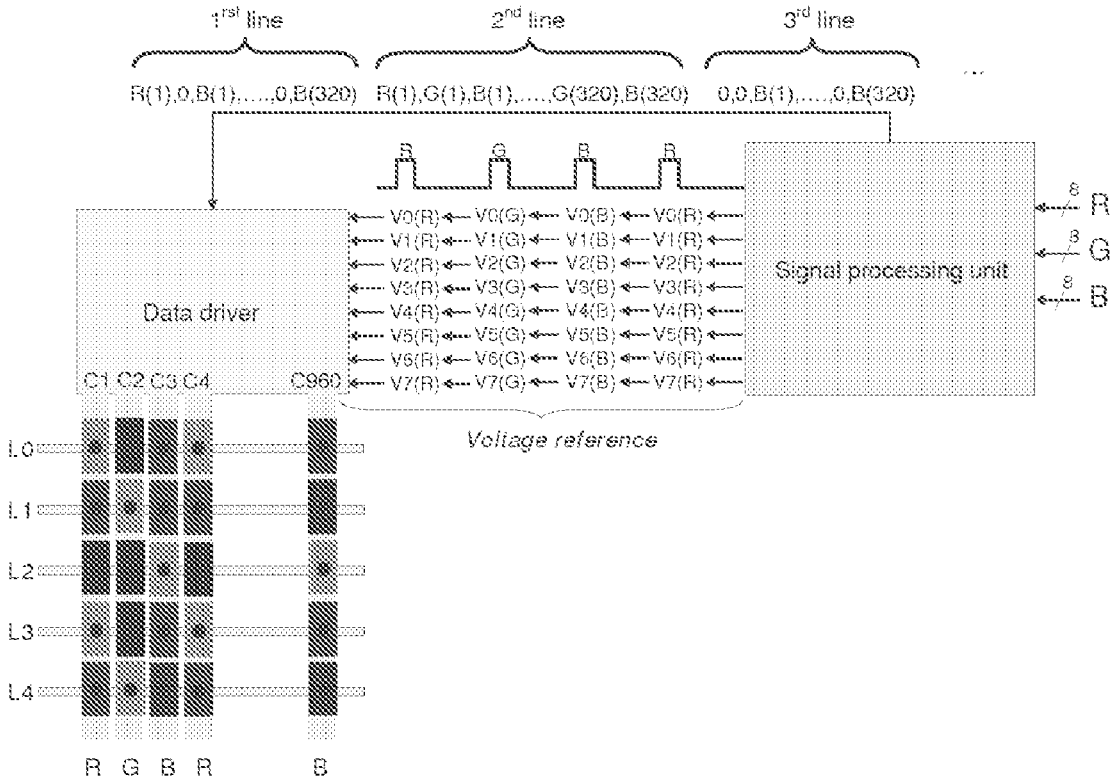
FIG. 13 illustrates the addressing of video data during a first sub-period of the video frame in an interleaved mode.

FIG. 13 illustrates a first sub-period during which all the lines are scanned once, the output voltages of the data driver for the first line of luminous elements being generated using the set of reference voltages dedicated to the red component, the output voltages of the data driver for the second line of luminous elements being generated using the set of reference voltages dedicated to the green component and the output voltages of the data driver for the third line of luminous elements being generated using the set of reference voltages dedicated to the blue component and so on.

Figure 14:
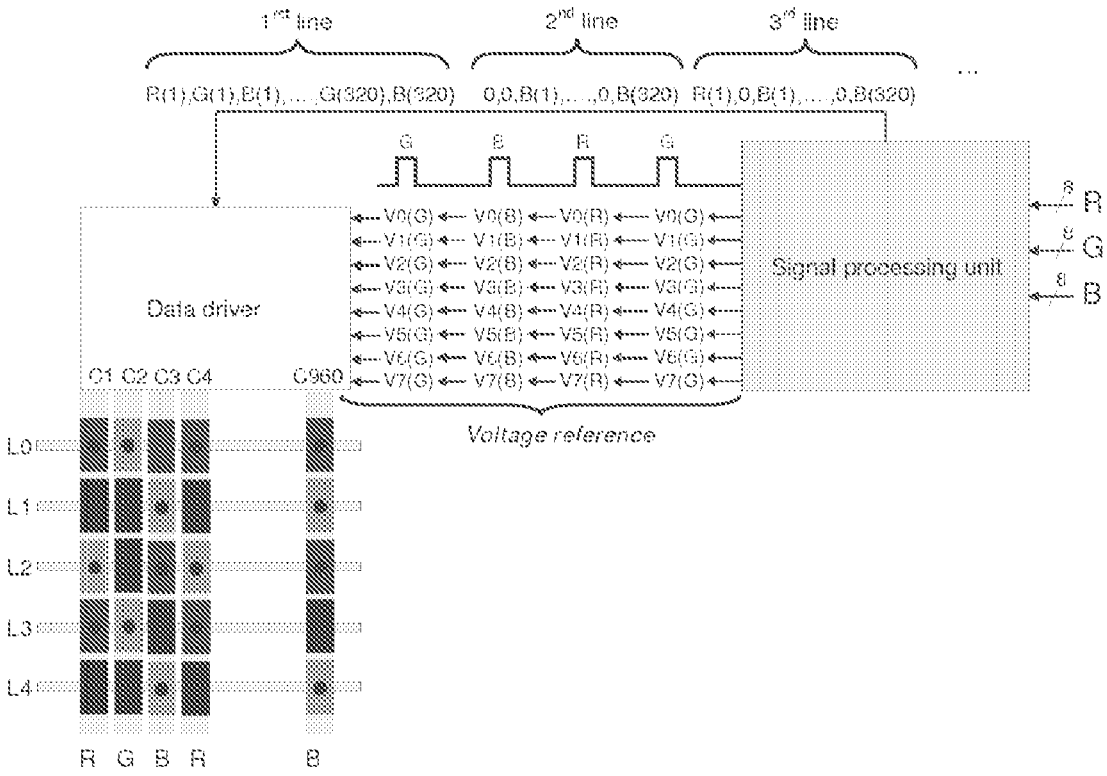
FIG. 14 illustrates the addressing of video data during a second sub-period of the video frame in an interleaved mode.

FIG. 14 illustrates a second sub-period during which all the lines are scanned once, the output voltages of the data driver for the first line of luminous elements being generated using the set of reference voltages dedicated to the green component, the output voltages of the data driver for the second line of luminous elements being generated using the set of reference voltages dedicated to the blue component and the output voltages of the data driver for the third line of luminous elements being generated using the set of reference voltages dedicated to the red component and so on.

Figure 15:
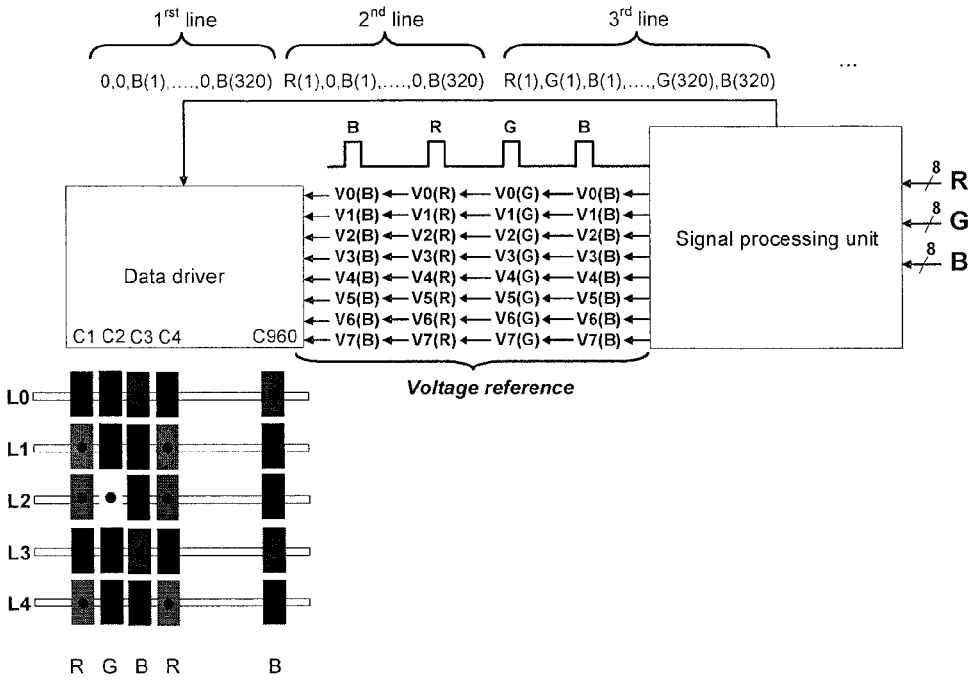
FIG. 15 illustrates the addressing of video data during a third sub-period of the video frame in an interleaved mode.

And finally FIG. 15 illustrates a third sub-period during which all the lines are scanned once, the output voltages of the data driver for the first line of luminous elements being generated using the set of reference voltages dedicated to the blue component, the output voltages of the data driver for the second line of luminous elements being generated using the set of reference voltages dedicated to the red component and the output voltages of the data driver for the third line of luminous elements being generated using the set of reference voltages dedicated to the red component and so on.

Thus, at the end of the 3 sub-periods (which corresponds to the end of the video frame), all the rows have been addressed with voltages based on the 3 sets of reference voltages (currents).

This interleaved mode reduces the visibility of the color break-up. Furthermore, it represents a simple solution that does not require any modification of the active matrix layout. As previously, the data driver is working three times faster than in a classical display device, i.e. a 180 Hz in a 60 hz mode and at 150 Hz in a 50 Hz mode. In this operation mode, it is no more possible to have different active time per colour component.

These two solutions have the advantage of not requiring any modification of the active matrix layout of the display device.

The invention is not restricted to the disclosed embodiments. Various modifications are possible and are considered to fall within the scope of the claims, e.g. other OLED materials with other threshold voltages and efficiencies can be used; a higher number of sub-frames can be used; other color component or group of colour components can be displayed during the sub-frames; the color components can also be displayed in a different order.

ANNEX

| Level | Voltage |
|---|---|
| 0 | V7 |
| 1 | V7 + (V6 − V7) × 9/1175 |
| 2 | V7 + (V6 − V7) × 32/1175 |
| 3 | V7 + (V6 − V7) × 76/1175 |
| 4 | V7 + (V6 − V7) × 141/1175 |
| 5 | V7 + (V6 − V7) × 224/1175 |
| 6 | V7 + (V6 − V7) × 321/1175 |
| 7 | V7 + (V6 − V7) × 425/1175 |
| 8 | V7 + (V6 − V7) × 529/1175 |
| 9 | V7 + (V6 − V7) × 630/1175 |
| 10 | V7 + (V6 − V7) × 727/1175 |
| 11 | V7 + (V6 − V7) × 820/1175 |
| 12 | V7 + (V6 − V7) × 910/1175 |
| 13 | V7 + (V6 − V7) × 998/1175 |
| 14 | V7 + (V6 − V7) × 1086/1175 |
| 15 | V6 |
| 16 | V6 + (V5 − V6) × 89/1097 |
| 17 | V6 + (V5 − V6) × 173/1097 |
| 18 | V6 + (V5 − V6) × 250/1097 |
| 19 | V6 + (V5 − V6) × 320/1097 |
| 20 | V6 + (V5 − V6) × 386/1097 |
| 21 | V6 + (V5 − V6) × 451/1097 |
| 22 | V6 + (V5 − V6) × 517/1097 |
| 23 | V6 + (V5 − V6) × 585/1097 |
| 24 | V6 + (V5 − V6) × 654/1097 |
| 25 | V6 + (V5 − V6) × 723/1097 |
| 26 | V6 + (V5 − V6) × 790/1097 |
| 27 | V6 + (V5 − V6) × 855/1097 |
| 28 | V6 + (V5 − V6) × 917/1097 |
| 29 | V6 + (V5 − V6) × 977/1097 |
| 30 | V6 + (V5 − V6) × 1037/1097 |
| 31 | V5 |
| 32 | V5 + (V4 − V5) × 60/1501 |
| 33 | V5 + (V4 − V5) × 119/1501 |
| 34 | V5 + (V4 − V5) × 176/1501 |
| 35 | V5 + (V4 − V5) × 231/1501 |
| 36 | V5 + (V4 − V5) × 284/1501 |
| 37 | V5 + (V4 − V5) × 335/1501 |
| 38 | V5 + (V4 − V5) × 385/1501 |
| 39 | V5 + (V4 − V5) × 434/1501 |
| 40 | V5 + (V4 − V5) × 483/1501 |
| 41 | V5 + (V4 − V5) × 532/1501 |
| 42 | V5 + (V4 − V5) × 580/1501 |
| 43 | V5 + (V4 − V5) × 628/1501 |
| 44 | V5 + (V4 − V5) × 676/1501 |
| 45 | V5 + (V4 − V5) × 724/1501 |
| 46 | V5 + (V4 − V5) × 772/1501 |
| 47 | V5 + (V4 − V5) × 819/1501 |
| 48 | V5 + (V4 − V5) × 866/1501 |
| 49 | V5 + (V4 − V5) × 912/1501 |
| 50 | V5 + (V4 − V5) × 957/1501 |

-continued

ANNEX

| Level | Voltage |
|---|---|
| 51 | V5 + (V4 − V5) × 1001/1501 |
| 52 | V5 + (V4 − V5) × 1045/1501 |
| 53 | V5 + (V4 − V5) × 1088/1501 |
| 54 | V5 + (V4 − V5) × 1131/1501 |
| 55 | V5 + (V4 − V5) × 1173/1501 |
| 56 | V5 + (V4 − V5) × 1215/1501 |
| 57 | V5 + (V4 − V5) × 1257/1501 |
| 58 | V5 + (V4 − V5) × 1298/1501 |
| 59 | V5 + (V4 − V5) × 1339/1501 |
| 60 | V5 + (V4 − V5) × 1380/1501 |
| 61 | V5 + (V4 − V5) × 1421/1501 |
| 62 | V5 + (V4 − V5) × 1461/1501 |
| 63 | V4 |
| 64 | V4 + (V3 − V4) × 40/2215 |
| 65 | V4 + (V3 − V4) × 80/2215 |
| 66 | V4 + (V3 − V4) × 120/2215 |
| 67 | V4 + (V3 − V4) × 160/2215 |
| 68 | V4 + (V3 − V4) × 200/2215 |
| 69 | V4 + (V3 − V4) × 240/2215 |
| 70 | V4 + (V3 − V4) × 280/2215 |
| 71 | V4 + (V3 − V4) × 320/2215 |
| 72 | V4 + (V3 − V4) × 360/2215 |
| 73 | V4 + (V3 − V4) × 400/2215 |
| 74 | V4 + (V3 − V4) × 440/2215 |
| 75 | V4 + (V3 − V4) × 480/2215 |
| 76 | V4 + (V3 − V4) × 520/2215 |
| 77 | V4 + (V3 − V4) × 560/2215 |
| 78 | V4 + (V3 − V4) × 600/2215 |
| 79 | V4 + (V3 − V4) × 640/2215 |
| 80 | V4 + (V3 − V4) × 680/2215 |
| 81 | V4 + (V3 − V4) × 719/2215 |
| 82 | V4 + (V3 − V4) × 758/2215 |
| 83 | V4 + (V3 − V4) × 796/2215 |
| 84 | V4 + (V3 − V4) × 834/2215 |
| 85 | V4 + (V3 − V4) × 871/2215 |
| 86 | V4 + (V3 − V4) × 908/2215 |
| 87 | V4 + (V3 − V4) × 944/2215 |
| 88 | V4 + (V3 − V4) × 980/2215 |
| 89 | V4 + (V3 − V4) × 1016/2215 |
| 90 | V4 + (V3 − V4) × 1052/2215 |
| 91 | V4 + (V3 − V4) × 1087/2215 |
| 92 | V4 + (V3 − V4) × 1122/2215 |
| 93 | V4 + (V3 − V4) × 1157/2215 |
| 94 | V4 + (V3 − V4) × 1192/2215 |
| 95 | V4 + (V3 − V4) × 1226/2215 |
| 96 | V4 + (V3 − V4) × 1260/2215 |
| 97 | V4 + (V3 − V4) × 1294/2215 |
| 98 | V4 + (V3 − V4) × 1328/2215 |
| 99 | V4 + (V3 − V4) × 1362/2215 |
| 100 | V4 + (V3 − V4) × 1396/2215 |
| 101 | V4 + (V3 − V4) × 1429/2215 |
| 102 | V4 + (V3 − V4) × 1462/2215 |
| 103 | V4 + (V3 − V4) × 1495/2215 |
| 104 | V4 + (V3 − V4) × 1528/2215 |
| 105 | V4 + (V3 − V4) × 1561/2215 |
| 106 | V4 + (V3 − V4) × 1593/2215 |
| 107 | V4 + (V3 − V4) × 1625/2215 |
| 108 | V4 + (V3 − V4) × 1657/2215 |
| 109 | V4 + (V3 − V4) × 1688/2215 |
| 110 | V4 + (V3 − V4) × 1719/2215 |
| 111 | V4 + (V3 − V4) × 1750/2215 |
| 112 | V4 + (V3 − V4) × 1781/2215 |
| 113 | V4 + (V3 − V4) × 1811/2215 |
| 114 | V4 + (V3 − V4) × 1841/2215 |
| 115 | V4 + (V3 − V4) × 1871/2215 |
| 116 | V4 + (V3 − V4) × 1901/2215 |
| 117 | V4 + (V3 − V4) × 1930/2215 |
| 118 | V4 + (V3 − V4) × 1959/2215 |
| 119 | V4 + (V3 − V4) × 1988/2215 |
| 120 | V4 + (V3 − V4) × 2016/2215 |
| 121 | V4 + (V3 − V4) × 2044/2215 |
| 122 | V4 + (V3 − V4) × 2072/2215 |
| 123 | V4 + (V3 − V4) × 2100/2215 |
| 124 | V4 + (V3 − V4) × 2128/2215 |
| 125 | V4 + (V3 − V4) × 2156/2215 |
| 126 | V4 + (V3 − V4) × 2185/2215 |

-continued

ANNEX

| Level | Voltage |
|---|---|
| 127 | V3 |
| 128 | V3 + (V2 − V3) × 31/2343 |
| 129 | V3 + (V2 − V3) × 64/2343 |
| 130 | V3 + (V2 − V3) × 97/2343 |
| 131 | V3 + (V2 − V3) × 130/2343 |
| 132 | V3 + (V2 − V3) × 163/2343 |
| 133 | V3 + (V2 − V3) × 196/2343 |
| 134 | V3 + (V2 − V3) × 229/2343 |
| 135 | V3 + (V2 − V3) × 262/2343 |
| 136 | V3 + (V2 − V3) × 295/2343 |
| 137 | V3 + (V2 − V3) × 328/2343 |
| 138 | V3 + (V2 − V3) × 361/2343 |
| 139 | V3 + (V2 − V3) × 395/2343 |
| 140 | V3 + (V2 − V3) × 429/2343 |
| 141 | V3 + (V2 − V3) × 463/2343 |
| 142 | V3 + (V2 − V3) × 497/2343 |
| 143 | V3 + (V2 − V3) × 531/2343 |
| 144 | V3 + (V2 − V3) × 566/2343 |
| 145 | V3 + (V2 − V3) × 601/2343 |
| 146 | V3 + (V2 − V3) × 636/2343 |
| 147 | V3 + (V2 − V3) × 671/2343 |
| 148 | V3 + (V2 − V3) × 706/2343 |
| 149 | V3 + (V2 − V3) × 741/2343 |
| 150 | V3 + (V2 − V3) × 777/2343 |
| 151 | V3 + (V2 − V3) × 813/2343 |
| 152 | V3 + (V2 − V3) × 849/2343 |
| 153 | V3 + (V2 − V3) × 885/2343 |
| 154 | V3 + (V2 − V3) × 921/2343 |
| 155 | V3 + (V2 − V3) × 958/2343 |
| 156 | V3 + (V2 − V3) × 995/2343 |
| 157 | V3 + (V2 − V3) × 1032/2343 |
| 158 | V3 + (V2 − V3) × 1069/2343 |
| 159 | V3 + (V2 − V3) × 1106/2343 |
| 160 | V3 + (V2 − V3) × 1143/2343 |
| 161 | V3 + (V2 − V3) × 1180/2343 |
| 162 | V3 + (V2 − V3) × 1217/2343 |
| 163 | V3 + (V2 − V3) × 1255/2343 |
| 164 | V3 + (V2 − V3) × 1293/2343 |
| 165 | V3 + (V2 − V3) × 1331/2343 |
| 166 | V3 + (V2 − V3) × 1369/2343 |
| 167 | V3 + (V2 − V3) × 1407/2343 |
| 168 | V3 + (V2 − V3) × 1445/2343 |
| 169 | V3 + (V2 − V3) × 1483/2343 |
| 170 | V3 + (V2 − V3) × 1521/2343 |
| 171 | V3 + (V2 − V3) × 1559/2343 |
| 172 | V3 + (V2 − V3) × 1597/2343 |
| 173 | V3 + (V2 − V3) × 1635/2343 |
| 174 | V3 + (V2 − V3) × 1673/2343 |
| 175 | V3 + (V2 − V3) × 1712/2343 |
| 176 | V3 + (V2 − V3) × 1751/2343 |
| 177 | V3 + (V2 − V3) × 1790/2343 |
| 178 | V3 + (V2 − V3) × 1829/2343 |
| 179 | V3 + (V2 − V3) × 1868/2343 |
| 180 | V3 + (V2 − V3) × 1907/2343 |
| 181 | V3 + (V2 − V3) × 1946/2343 |
| 182 | V3 + (V2 − V3) × 1985/2343 |
| 183 | V3 + (V2 − V3) × 2024/2343 |
| 184 | V3 + (V2 − V3) × 2064/2343 |
| 185 | V3 + (V2 − V3) × 2103/2343 |
| 186 | V3 + (V2 − V3) × 2143/2343 |
| 187 | V3 + (V2 − V3) × 2183/2343 |
| 188 | V3 + (V2 − V3) × 2223/2343 |
| 189 | V3 + (V2 − V3) × 2263/2343 |
| 190 | V3 + (V2 − V3) × 2303/2343 |
| 191 | V2 |
| 192 | V2 + (V1 − V2) × 40/1638 |
| 193 | V2 + (V1 − V2) × 81/1638 |
| 194 | V2 + (V1 − V2) × 124/1638 |
| 195 | V2 + (V1 − V2) × 168/1638 |
| 196 | V2 + (V1 − V2) × 213/1638 |
| 197 | V2 + (V1 − V2) × 259/1638 |
| 198 | V2 + (V1 − V2) × 306/1638 |
| 199 | V2 + (V1 − V2) × 353/1638 |
| 200 | V2 + (V1 − V2) × 401/1638 |
| 201 | V2 + (V1 − V2) × 450/1638 |
| 202 | V2 + (V1 − V2) × 499/1638 |

-continued

ANNEX

| Level | Voltage |
|---|---|
| 203 | V2 + (V1 − V2) × 548/1638 |
| 204 | V2 + (V1 − V2) × 597/1638 |
| 205 | V2 + (V1 − V2) × 646/1638 |
| 206 | V2 + (V1 − V2) × 695/1638 |
| 207 | V2 + (V1 − V2) × 745/1638 |
| 208 | V2 + (V1 − V2) × 795/1638 |
| 209 | V2 + (V1 − V2) × 846/1638 |
| 210 | V2 + (V1 − V2) × 897/1638 |
| 211 | V2 + (V1 − V2) × 949/1638 |
| 212 | V2 + (V1 − V2) × 1002/1638 |
| 213 | V2 + (V1 − V2) × 1056/1638 |
| 214 | V2 + (V1 − V2) × 1111/1638 |
| 215 | V2 + (V1 − V2) × 1167/1638 |
| 216 | V2 + (V1 − V2) × 1224/1638 |
| 217 | V2 + (V1 − V2) × 1281/1638 |
| 218 | V2 + (V1 − V2) × 1339/1638 |
| 219 | V2 + (V1 − V2) × 1398/1638 |
| 220 | V2 + (V1 − V2) × 1458/1638 |
| 221 | V2 + (V1 − V2) × 1518/1638 |
| 222 | V2 + (V1 − V2) × 1578/1638 |
| 223 | V1 |
| 224 | V1 + (V0 − V1) × 60/3029 |
| 225 | V1 + (V0 − V1) × 120/3029 |
| 226 | V1 + (V0 − V1) × 180/3029 |
| 227 | V1 + (V0 − V1) × 241/3029 |
| 228 | V1 + (V0 − V1) × 304/3029 |
| 229 | V1 + (V0 − V1) × 369/3029 |
| 230 | V1 + (V0 − V1) × 437/3029 |
| 231 | V1 + (V0 − V1) × 507/3029 |
| 232 | V1 + (V0 − V1) × 580/3029 |
| 233 | V1 + (V0 − V1) × 655/3029 |
| 234 | V1 + (V0 − V1) × 732/3029 |
| 235 | V1 + (V0 − V1) × 810/3029 |
| 236 | V1 + (V0 − V1) × 889/3029 |
| 237 | V1 + (V0 − V1) × 969/3029 |
| 238 | V1 + (V0 − V1) × 1050/3029 |
| 239 | V1 + (V0 − V1) × 1133/3029 |
| 240 | V1 + (V0 − V1) × 1218/3029 |
| 241 | V1 + (V0 − V1) × 1304/3029 |
| 242 | V1 + (V0 − V1) × 1393/3029 |
| 243 | V1 + (V0 − V1) × 1486/3029 |
| 244 | V1 + (V0 − V1) × 1583/3029 |
| 245 | V1 + (V0 − V1) × 1686/3029 |
| 246 | V1 + (V0 − V1) × 1794/3029 |
| 247 | V1 + (V0 − V1) × 1907/3029 |
| 248 | V1 + (V0 − V1) × 2026/3029 |
| 249 | V1 + (V0 − V1) × 2150/3029 |
| 250 | V1 + (V0 − V1) × 2278/3029 |
| 251 | V1 + (V0 − V1) × 2411/3029 |
| 252 | V1 + (V0 − V1) × 2549/3029 |
| 253 | V1 + (V0 − V1) × 2694/3029 |
| 254 | V1 + (V0 − V1) × 2851/3029 |
| 255 | V0 |

The invention claimed is:

1. Method for displaying a picture in an active matrix organic light emitting display having a plurality of luminous elements each dedicated to a colour component among at least three colour components of pixels of a picture, wherein the luminance generated by each of said luminous elements is based on the intensity of a signal supplied to said luminous element, the intensity of said signal being defined as a function of reference signals, comprising the following steps addressing the picture at least three times during the video frame such that the video frame is split into at least three sub-frames, and wherein the first, second and third colour components are displayed during the first sub-frame with only reference signals dedicated to the first colour component, the second and third colour components are only displayed during the second sub-frame with only reference signals dedicated to the second colour component and the third colour component is only displayed during the third sub-frame with only reference signals dedicated to said third colour component.

2. Method according to claim 1, wherein the three colour components are a red component, a green component and a blue component.

3. Method according to claim 2, wherein the red, green and blue components are displayed during the first sub-frame with the set of reference signals dedicated to the green component, the red and blue components are displayed during the second sub-frame with the set of reference signals dedicated to the red component and the blue component is displayed during the third sub-frame with the set of reference signals dedicated to said colour component.

4. Display device comprising an active matrix containing an array of luminous elements arranged in rows and columns, each luminous element being used for displaying a colour component among at least three colour components of pixels of a picture to be displayed a row driver for selecting row by row the luminous elements of the matrix;

a column driver for delivering a signal to each luminous element of the row selected by the row driver, said signal depending on the video information to be displayed by said luminous element and a set of reference signals; and a digital processing unit for delivering the video information and the set of reference signals to the column driver and control signals to the row driver, wherein the digital processing unit controls the row driver and delivers video information and reference signals to the column driver such that the picture is addressing at least three times during the video frame and that the video frame is split into at least three sub-frames, wherein the first, second and third colour components are displayed during the first sub-frame only with reference signals dedicated to the first colour component, the second and third colour components are only displayed during the second sub-frame with only reference signals dedicated to the second colour component and the third colour component is only displayed during the third sub-frame with only reference signals dedicated to said third colour component.

* * * * *